US008925675B2

(12) United States Patent
Huang et al.

(10) Patent No.: US 8,925,675 B2
(45) Date of Patent: Jan. 6, 2015

(54) COMPOUND MEMBRANE AND ACOUSTIC DEVICE USING SAME

(71) Applicants: Xing-Zhi Huang, Shenzhen (CN); Jing He, Shenzhen (CN)

(72) Inventors: Xing-Zhi Huang, Shenzhen (CN); Jing He, Shenzhen (CN)

(73) Assignees: AAC Acoustic Technologies (Shenzhen) Co., Ltd., Shenzhen (CN); American Audio Components (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/033,565

(22) Filed: Sep. 23, 2013

(65) Prior Publication Data

US 2014/0083795 A1 Mar. 27, 2014

(30) Foreign Application Priority Data

Sep. 26, 2012 (CN) ..... 2012 2 0498023 U

(51) Int. Cl.

| | |
|---|---|
| ***H04R 7/10*** | (2006.01) |
| ***H04R 7/06*** | (2006.01) |
| ***H04R 7/12*** | (2006.01) |
| *H04R 7/00* | (2006.01) |
| *H04R 7/02* | (2006.01) |

(52) U.S. Cl.

CPC ..... *H04R 7/06* (2013.01); *H04R 7/125* (2013.01); *H04R 2307/025* (2013.01); *H04R 2307/204* (2013.01)

USPC ..... 181/167; 181/170; 381/426

(58) Field of Classification Search

CPC ..... G10K 13/00; H04R 7/10; H04R 7/06; H04R 7/02; H04R 7/122; H04R 7/125

USPC ..... 181/167, 170, 171, 172; 381/426

See application file for complete search history.

(56) References Cited

U.S. PATENT DOCUMENTS

| | | | | |
|---|---|---|---|---|
| 5,259,036 | A * | 11/1993 | Seeler | 381/426 |
| 5,274,199 | A * | 12/1993 | Uryu et al. | 181/169 |
| 5,473,121 | A * | 12/1995 | Uryu | 181/169 |
| 5,744,761 | A * | 4/1998 | Ogura et al. | 181/167 |
| 6,422,337 | B1 * | 7/2002 | Tseng | 181/171 |
| 7,631,723 | B2 * | 12/2009 | Ono et al. | 181/169 |
| 8,442,261 | B2 * | 5/2013 | Kamimura et al. | 381/423 |
| 2010/0040246 | A1 * | 2/2010 | Windischberger et al. | 381/150 |

FOREIGN PATENT DOCUMENTS

| | | | | |
|---|---|---|---|---|
| JP | 55135498 | A * | 10/1980 | H04R 7/20 |

* cited by examiner

*Primary Examiner* — Edgardo San Martin

(74) *Attorney, Agent, or Firm* — Ipro, Inc.; Na Xu

(57) ABSTRACT

The present disclosure provides a compound membrane and an acoustic device including such a compound membrane. The compound membrane includes a polyetherimide film, and a thermoplastic polyurethance elastomer attached to one surface of the polyetherimide film.

2 Claims, 1 Drawing Sheet

COMPOUND MEMBRANE AND ACOUSTIC DEVICE USING SAME

FIELD OF THE INVENTION

The disclosure described herein relates to acoustic devices, and more particularly to a compound membrane used in such an acoustic device capable of providing sound.

DESCRIPTION OF RELATED ART

Nowadays, speakers and/or microphones often comprise compound membranes which are basically a combination of layers of different materials or just a mixture of different materials.

Generally, a membrane is formed by a single film or by hot pressing a piece of thermoplastic material, the rigidity of the membrane is not enough when vibrating. In addition, to increase the rigidity of the membrane, the usual method is to increase the thickness of the membrane. However, a membrane is formed by a single film, whose thickness of different portion are the same, as a result, the sound quality of the acoustic device is undesirable when the membrane vibrates.

The present disclosure is provided to solve the problems mentioned above.

DETAILED DESCRIPTION OF THE EXEMPLARY EMBODIMENTS

Reference will now be made to describe exemplary embodiments of the present disclosure in detail.

Figure 1:
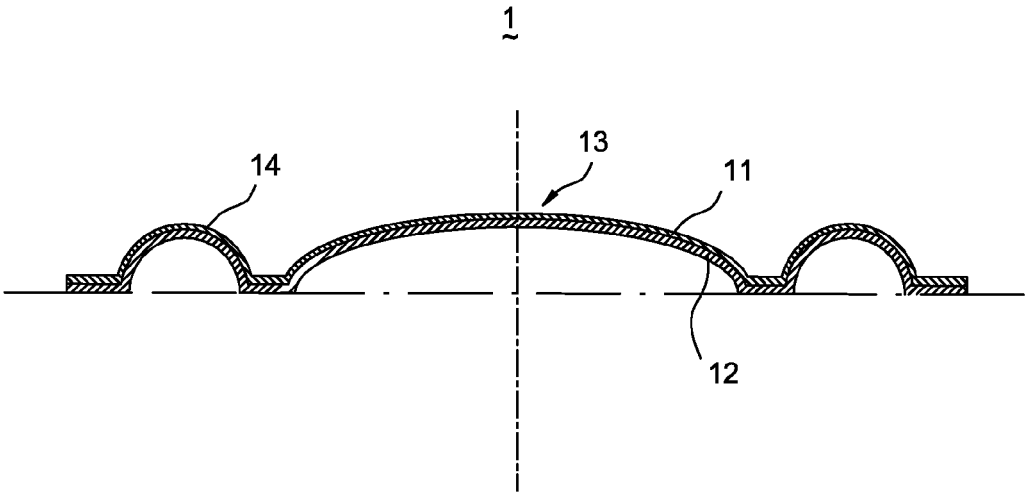
FIG. 1 is an illustrative cross-sectional view of a compound membrane according to an exemplary embodiment of the present disclosure.

Referring to FIG. 1, a compound membrane 1 comprises a central portion 13 and a peripheral portion 14 surrounding the central portion 13. The compound membrane 1 includes a polyetherimide (PEI) film 11 and a thermoplastic polyurethane (TPU) elastomer 12 attached to the surface of the PEI film 11. The TPU elastomer 12 is attached to the PEI film 11 by adhesion or other feasible methods, for example, hot pressing bonding, or ultrasonic welding. The TPU elastomer 12 covers the PEI film 11 completely.

In an alternative embodiment, the TPU elastomer may overlap the PEI film at a portion corresponding to the periphery portion. Another word, the central portion of the membrane is formed by the PEI film and the peripheral portion of the membrane is formed by the compound of the PEI film and the TPU elastomer.

Figure 2:
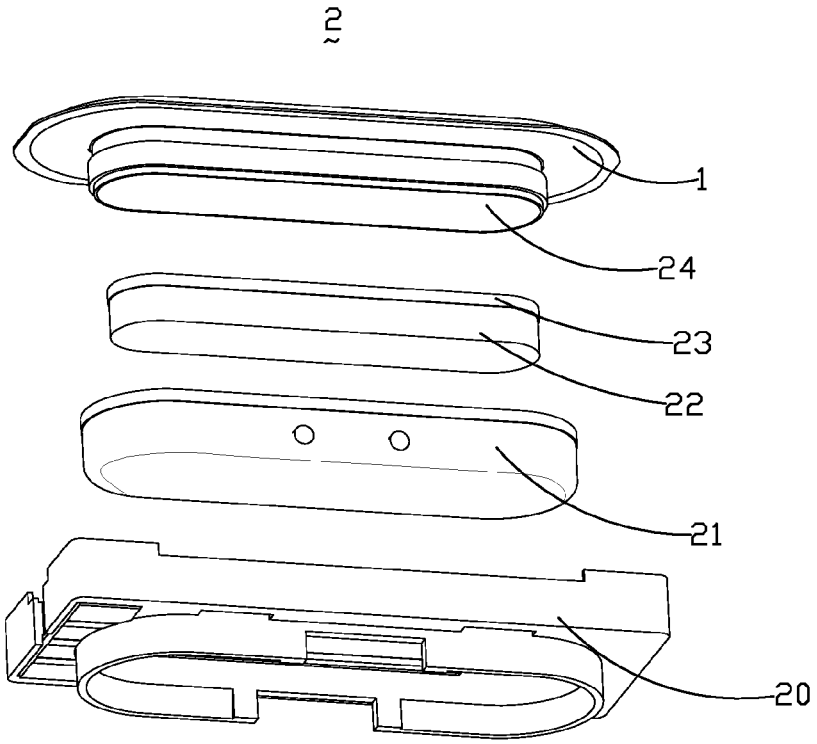
FIG. 2 is an exploded view of an acoustic device using the membrane in FIG. 1.

FIG. 2 shows an acoustic device 2 comprising such a compound membrane 1 according to the exemplary embodiment of the present disclosure. The acoustic device 2 further comprises a frame 20, a york 20 received in the frame 20, a magnet 22 received in the york 20, a pole plate 23 attached to the magnet 22, and a coil 24 with one end thereof received in a gap formed by the yoke 20 and the magnet 22 and another end fixed to the membrane 1.

Compared with the related membrane, the compound membrane of the present disclosure has a higher ragidity and a better stability due to the compound of the TPU elastomer attached on the surface of the PEI film.

While the present disclosure has been described with reference to the specific embodiments, the description of the disclosure is illustrative and is not to be construed as limiting the disclosure. Various of modifications to the present disclosure can be made to the exemplary embodiments by those skilled in the art without departing from the true spirit and scope of the disclosure as defined by the appended claims.

What is claimed is:

1. A compound membrane comprising:

a polyetherimide film; and a thermoplastic polyurethane elastomer attached to one surface of the polyetherimide film; and wherein the compound membrane comprises a central portion and a peripheral portion surrounding the central portion, the central portion is formed by a single layer of the polyetherimide film and the peripheral portion is formed by the compound of the polyetherimide film and the thermoplastic polyurethane elastomer.

2. An acoustic device comprising:

a compound membrane as described in claim 1.

* * * * *